US009551092B2

(12) United States Patent
Pryne

(10) Patent No.: US 9,551,092 B2
(45) Date of Patent: Jan. 24, 2017

(54) MULTI-FIBER CARDING APPARATUS AND METHOD

(71) Applicant: American Felt & Filter Company, New Windsor, NY (US)

(72) Inventor: Wilson H. Pryne, Jefferson, NY (US)

(73) Assignee: American Felt & Filter Company, New Windsor, NY (US)

( * ) Notice: Subject to any disclaimer, the term of this patent is extended or adjusted under 35 U.S.C. 154(b) by 63 days.

(21) Appl. No.: 14/742,728

(22) Filed: Jun. 18, 2015

(65) Prior Publication Data

US 2016/0032497 A1 Feb. 4, 2016

Related U.S. Application Data

(60) Provisional application No. 62/030,129, filed on Jul. 29, 2014.

(51) Int. Cl.

| | |
|---|---|
| ***D01G 15/40*** | (2006.01) |
| ***D02J 13/00*** | (2006.01) |
| ***D02J 11/00*** | (2006.01) |
| ***D01G 13/00*** | (2006.01) |
| ***D01G 15/02*** | (2006.01) |

(52) U.S. Cl.

CPC ..... *D01G 15/40* (2013.01); *D01G 13/00* (2013.01); *D01G 15/02* (2013.01); *D02J 11/00* (2013.01); *D02J 13/00* (2013.01)

(58) Field of Classification Search

CPC ..... D01G 15/02; D01G 15/00; D01G 15/40; D01G 15/44

USPC ..... 19/145.7, 98, 105; 57/238

See application file for complete search history.

(56) References Cited

U.S. PATENT DOCUMENTS

| | | | | | |
|---|---|---|---|---|---|
| 395,632 | A * | 1/1889 | Robb | D01G 13/00 | 19/145.7 |
| 1,439,347 | A * | 12/1922 | Whipple | D01G 15/62 | 19/145.7 |
| 1,688,524 | A * | 10/1928 | Cobb | D01G 9/00 | 100/73 |
| 2,159,992 | A * | 5/1939 | Hunt | D01G 99/00 | 19/145.7 |
| 2,323,167 | A * | 6/1943 | Varga | D01G 15/94 | 19/65 CR |
| 2,331,944 | A * | 10/1943 | Steingraeber | C03B 37/022 | 19/66 R |
| 2,357,392 | A * | 9/1944 | Francis, Jr. | D01D 5/06 | 106/170.18 |

(Continued)

*Primary Examiner* — Shaun R Hurley
*Assistant Examiner* — Bao-Thieu L Nguyen
(74) *Attorney, Agent, or Firm* — Nixon & Vanderhye, P.C.

(57) ABSTRACT

A method of forming carded fibers of different materials. A feed system has a plurality of separate laterally spaced chambers containing fibers of different materials. The different fibers are fed in separate laterally spaced paths into a carding apparatus having a plurality of rollers and cylinders each having laterally spaced sections in alignment with the laterally spaced paths to receive and maintain the different fibers in the laterally spaced paths thereon as they move through the carding apparatus. The different fibers are combined into a multi-fiber roving or web after they exit the carding apparatus. Depending on the composition of the different fibers, they may be combined by conveying them through a humidifying and heated chamber or chambers.

13 Claims, 16 Drawing Sheets

(56) References Cited

U.S. PATENT DOCUMENTS 2,421,010 A * 5/1947 Cavedon ..... D01G 15/70 19/145.7
2,710,429 A * 6/1955 Paulus ..... D01G 99/00 19/105
2,729,860 A * 1/1956 Balkin ..... D01H 5/86 19/153
2,988,469 A * 6/1961 Watson ..... B01D 39/1623 19/304
3,068,547 A * 12/1962 L Hommedieu ..... D04H 5/03 162/108
3,080,617 A * 3/1963 Lytton ..... D01G 13/00 19/100
3,192,571 A * 7/1965 Halleux ..... D01G 7/04 19/105
3,244,302 A * 4/1966 Best ..... B01D 39/2024 19/299
3,373,461 A * 3/1968 Bessette ..... D01G 15/08 19/105
3,657,773 A * 4/1972 Whitehurst ..... D01G 13/00 19/145.5
3,963,392 A * 6/1976 Goyal ..... D21H 5/2628 156/62.2
3,994,046 A * 11/1976 Brown ..... D01H 5/72 19/150
4,016,629 A * 4/1977 Brown ..... D01H 13/04 19/243
4,240,182 A * 12/1980 Leifeld ..... D01G 7/04 19/145.5
4,520,531 A * 6/1985 Hergeth ..... D01G 23/04 19/105
4,535,512 A * 8/1985 Glazener ..... D01G 19/14 19/223
4,568,581 A * 2/1986 Peoples, Jr. ..... B29C 43/006 19/302
4,583,267 A * 4/1986 Fehrer ..... D01G 15/04 19/145.7
4,587,691 A * 5/1986 Hosel ..... D01G 13/00 19/145.5
4,979,274 A * 12/1990 McCullough, Jr. .... D02G 1/205 19/66.1
5,202,182 A * 4/1993 Knox ..... D01F 6/60 428/364
5,253,392 A * 10/1993 Ripley ..... D01G 21/00 19/105
5,329,668 A * 7/1994 Schlichter ..... D01G 13/00 19/145.5
5,459,990 A * 10/1995 Tsuzuki ..... B65H 67/064 19/145.5
5,617,613 A * 4/1997 Ripley ..... D01G 21/00 19/115 R
5,634,243 A * 6/1997 Ripley ..... D01G 21/00 19/115 R
6,112,384 A * 9/2000 Barnes ..... D01G 13/00 19/145.7
6,212,738 B1 * 4/2001 Appeltauer ..... D01G 9/12 19/105
6,276,028 B1 * 8/2001 Pinto ..... D01G 13/00 19/105
6,408,488 B1 * 6/2002 Leder ..... D01G 15/28 19/103
6,571,428 B2 * 6/2003 Patelli ..... D01G 15/20 19/105
6,692,825 B2 * 2/2004 Qin ..... D04H 3/16 428/357
7,123,024 B2 * 10/2006 Gohler ..... D01G 21/006 19/239
7,197,793 B2 * 4/2007 Thordahl ..... B27N 3/14 19/306
7,454,816 B2 * 11/2008 Popper ..... D01G 1/08 19/0.35
7,559,121 B2 * 7/2009 Perrotto ..... D01G 1/08 19/0.39
7,578,033 B2 * 8/2009 Schlichter ..... D01G 15/16 19/98
7,610,659 B2 * 11/2009 Current ..... D04H 1/54 19/161.1
7,779,512 B2 * 8/2010 Bernhardt ..... D01G 23/06 19/105
8,091,181 B2 * 1/2012 Van Doorn ..... D01B 1/04 19/66 CC
2004/0010890 A1 * 1/2004 Maidel ..... D01G 15/88 19/98
2009/0293232 A1 * 12/2009 Breuer ..... D01G 15/18 19/106 R
2010/0180405 A1 * 7/2010 Mascheretti ..... D01G 9/12 19/97.5
2013/0255048 A1 * 10/2013 Crary ..... D06C 11/00 28/162
2014/0120322 A1 * 5/2014 Fu ..... D04H 1/4242 428/176
2014/0331456 A1 * 11/2014 Wu ..... D04H 1/413 19/305
2015/0057379 A1 * 2/2015 Bork ..... B29B 17/02 521/48
2015/0218742 A1 * 8/2015 Stralin ..... D04H 1/4382 442/337
2016/0044958 A1 * 2/2016 Sebastian ..... A24D 3/063 131/332
2016/0204443 A1 * 7/2016 Tatsuno ..... D21H 13/50 264/29.1

* cited by examiner

| Usage | Sample Weight (g) | Sample Length (in) | Sample Length (mm) | Weight/ Length (g/mm) | Area ($mm^2$) | New Weight/mm (g/mm) | Weight/ Needed (g/mm) | Area Needed ($mm^2$) |
|---|---|---|---|---|---|---|---|---|
| Stripper | 3.4 | 2.391 | 60.722 | 0.0560 | 6.0071 | 0.0472 | 0.0088 | 1.126 |
| Lickerin | 2.2 | 2.469 | 62.706 | 0.0351 | 3.9886 | 0.0313 | 0.0038 | 0.481 |
| Lickerin | 1.7 | 2.516 | 63.897 | 0.0266 | 2.993 | 0.0235 | 0.0031 | 0.396 |
| Cylinder | 1.7 | 2.547 | 64.691 | 0.0263 | 3.0316 | 0.0238 | 0.0025 | 0.316 |
| Cylinder | 1.3 | 2.500 | 63.500 | 0.0205 | 2.55 | 0.0200 | 0.0005 | 0.058 |
| Worker/Doffer | 1.3 | 2.531 | 64.294 | 0.0202 | 2.4196 | 0.0190 | 0.0012 | 0.156 |
| High Loft Worker | 1.4 | 2.375 | 60.325 | 0.0232 | 2.683 | 0.0211 | 0.0021 | 0.273 |
| Cylinder | 1 | 2.438 | 61.913 | 0.0162 | 1.96675 | 0.0154 | 0.0007 | 0.091 |
| Worker/Doffer | 1.1 | 2.484 | 63.103 | 0.0174 | 1.973 | 0.0155 | 0.0019 | 0.248 |
| Worker/Doffer | 1 | 2.531 | 64.294 | 0.0156 | 1.741 | 0.0137 | 0.0019 | 0.240 |
| Condenser | 0.8 | 2.344 | 59.531 | 0.0134 | 1.3585 | 0.0107 | 0.0028 | 0.353 |

| Usage | |
|---|---|
| Density of Steel ($g/mm^3$) | 0.00785 |

Figure 7

MULTI-FIBER CARDING APPARATUS AND METHOD

This application claims the priority of Provisional Patent Application No. 62/030,129 filed on Jul. 29, 2014.

BACKGROUND OF THE INVENTION

I. Field of the Invention

The present application relates to a carding apparatus and method and, more particularly, to a new and improved carding apparatus and method for forming webs, rovings or the like of different types of fibers or materials.

II. Description of the Background Art

At the present time, conventional carding apparatus produces webs or rovings of a single material. If it is desired to produce a web comprised of fibers of different materials, it is necessary to produce a web of each material in a separate carding apparatus and method and thereafter combine webs of selected materials to produce a multi-fiber web. This process is slow, time consuming and therefore expensive. Also, webs of different materials must be produced in apparatus separate from the carding apparatus, thereby adding further to the complexity of producing carded webs or rovings of different materials.

A need has arisen, therefore, for a new and improved carding apparatus and method which provides for the production of webs or rovings of different materials in a single carding apparatus and method. The method and apparatus of the present invention meets this need.

BRIEF SUMMARY OF THE INVENTION

In accordance with the new and improved carding apparatus and method of the present invention, fibers of different materials are fed from different laterally spaced shoots of a feed system to corresponding laterally spaced sections on the worker, stripper and main cylinders of a carding apparatus. The separate laterally spaced sections on the cylinders of the carding apparatus are defined by raised bands formed on the cylinders in a desired laterally spaced relation. In this manner, webs of different materials are processed in the carding apparatus in laterally spaced relation and any suitable number of desired fibers can be so processed in laterally spaced relation depending on the length of the carding cylinders and the spacing of the separating bands formed thereon.

Upon completion of the processing of the different fibers in laterally spaced relation in the carding apparatus, the fibers of different materials are then combined in any suitable manner to form multi-fiber webs or rovings which can then be fed to a suitable storage drum or the like for further processing or use.

In cases where it is necessary to combine different fibers by subjecting them to heat, the multi-fiber web or roving is further processed in accordance with the present invention by conveying it through a heated water spray, a steam chamber, a microwave chamber and a cold or heated die process.

It is apparent, therefore, that the new and improved carding apparatus and method of the present invention makes it possible to produce webs or rovings of any suitable or desired different materials in a single operation in a carding apparatus, thereby saving considerable time and expense to increase the efficiency of the carding operation. The carding apparatus and method of the present invention may be used to produce webs or rovings of different materials of any suitable or desired type which can be used to form any suitable or desired product for any type of use.

BRIEF DESCRIPTION OF THE DRAWINGS

FIG. 7 is a chart showing the specifications for different wires to be used on the cylinders of the carding apparatus of the present invention;

DETAILED DESCRIPTION OF THE INVENTION

Figure 1A:
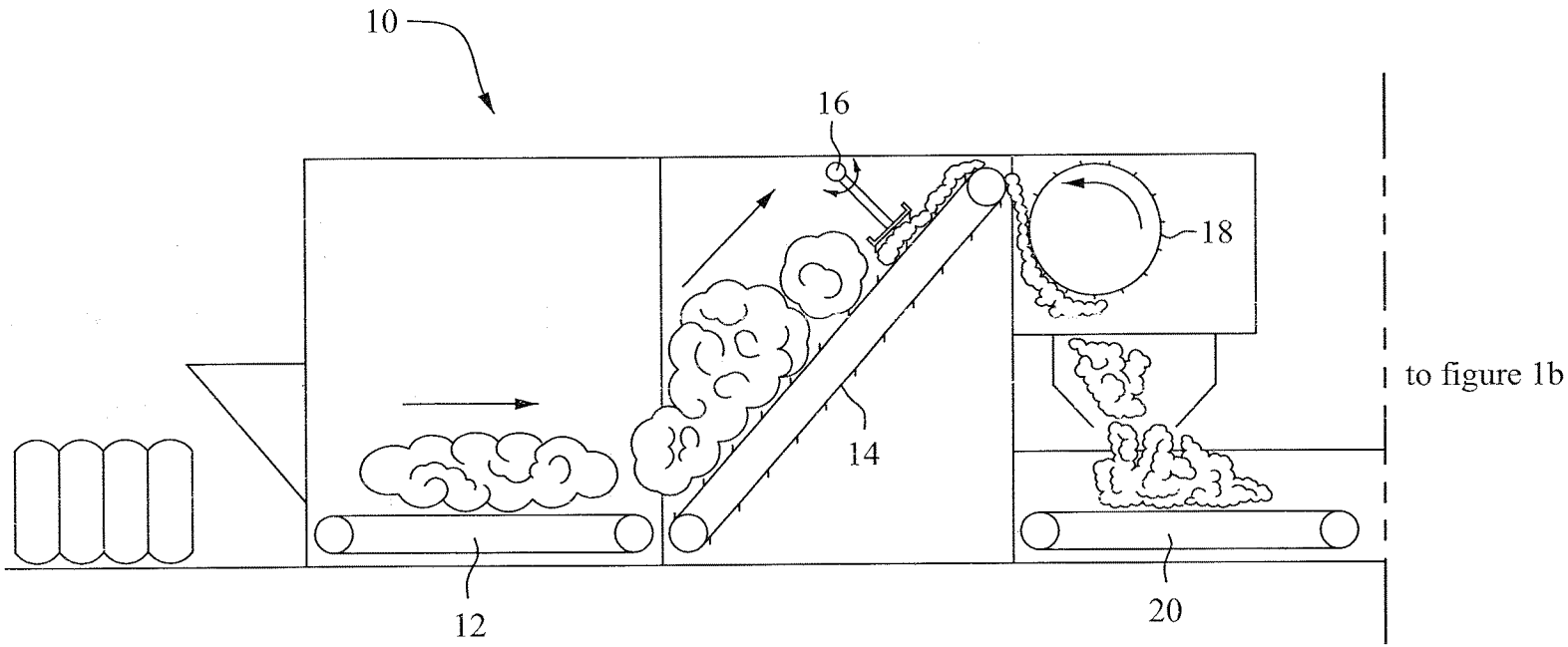
Figure 1a (Prior Art)
FIGS. 1*a*, 1*b*, 1*c* and 1*d* are schematic side elevational views of a picker or feed system that can be used to feed fibers of different materials to the carding apparatus of the present invention.
Figure 1B:
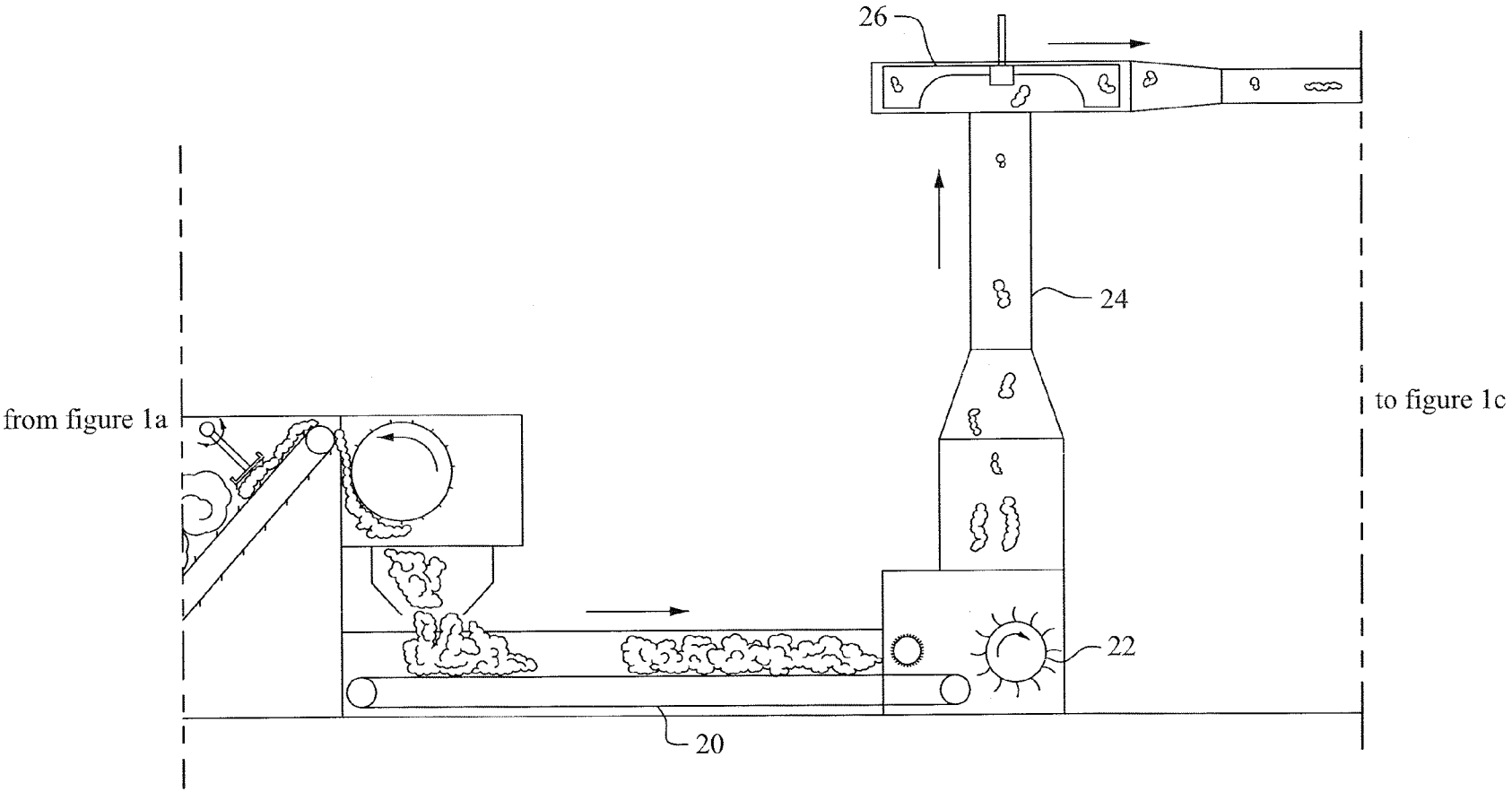
Figure 1b (Prior Art)
Figure 1C:
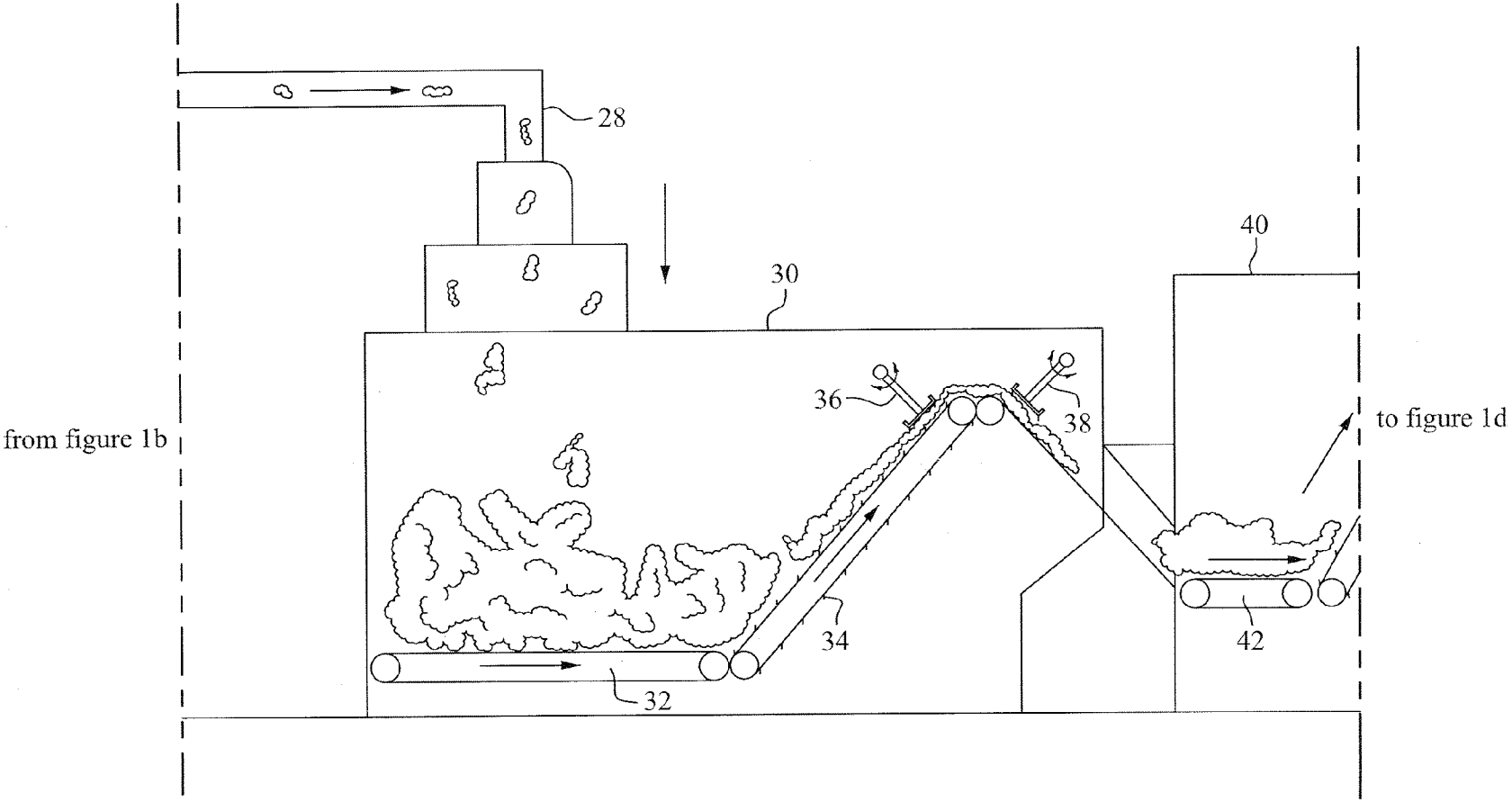
Figure 1c (Prior Art)
Figure 1D:
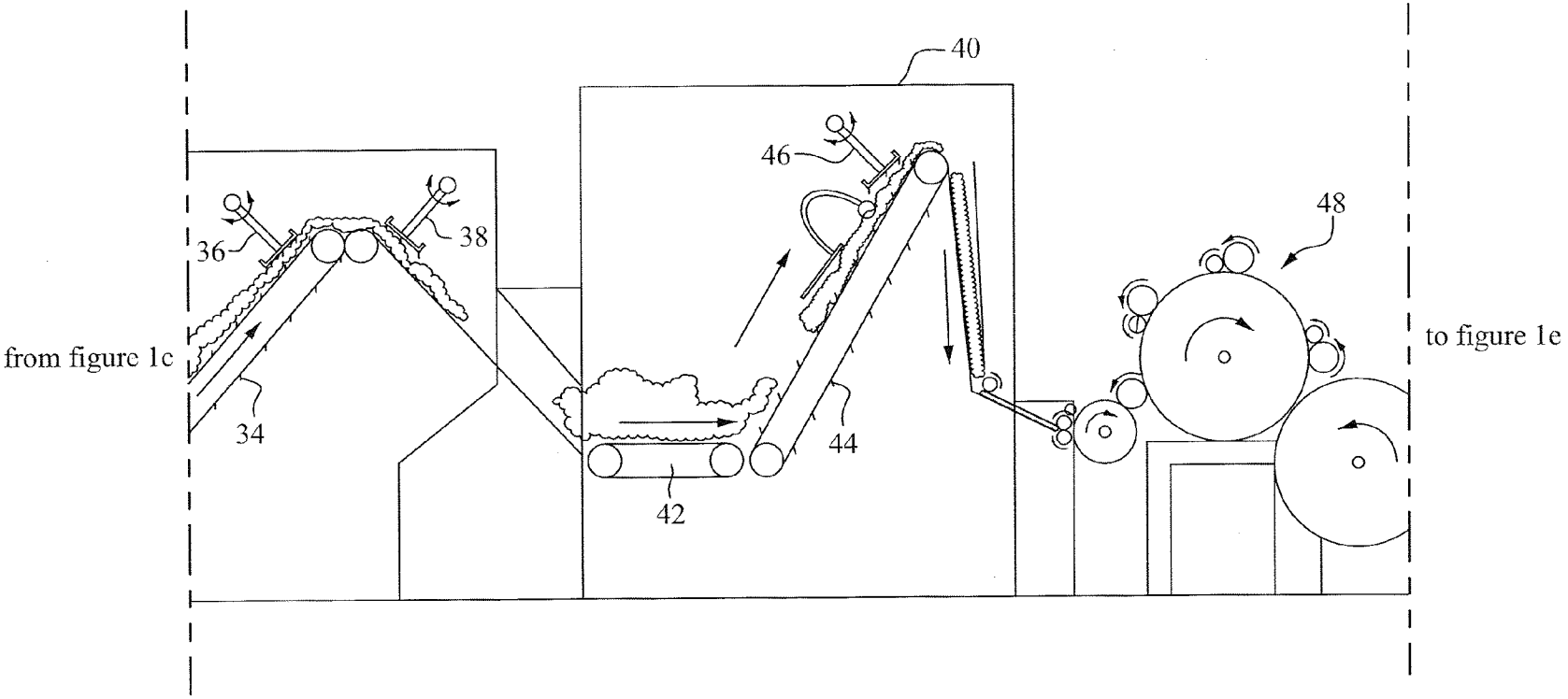
Figure 1d (Prior Art)

FIGS. 1*a*-1*d* illustrate one embodiment of a picker or feed system that can be used to feed fiber to a carding apparatus. The picker/feed system 10 generally comprises a first conveyor for moving fiber to a spiked apron 14 that moves the fiber through a spiked comb 16 and then to a spiked roller 18 from which the fiber is deposited on a second conveyor 20 that conveys the fiber to a blower 22 and upwardly through duct work 24 to a fan 26. The fiber is then blown by the fan 26 through duct work 28 into a feed box 30 in which the fiber is deposited on a third conveyor 32 and onto a spiked apron 34 and through spiked combs 36 and 38. The fiber is conveyed from the spiked comb 38 into a carding hopper 40 having a fourth conveyor 42 and a spiked apron 44 that moves the fiber through a spiked comb 46. The fiber is then moved in web form into the carding apparatus 48.

Figure 2:
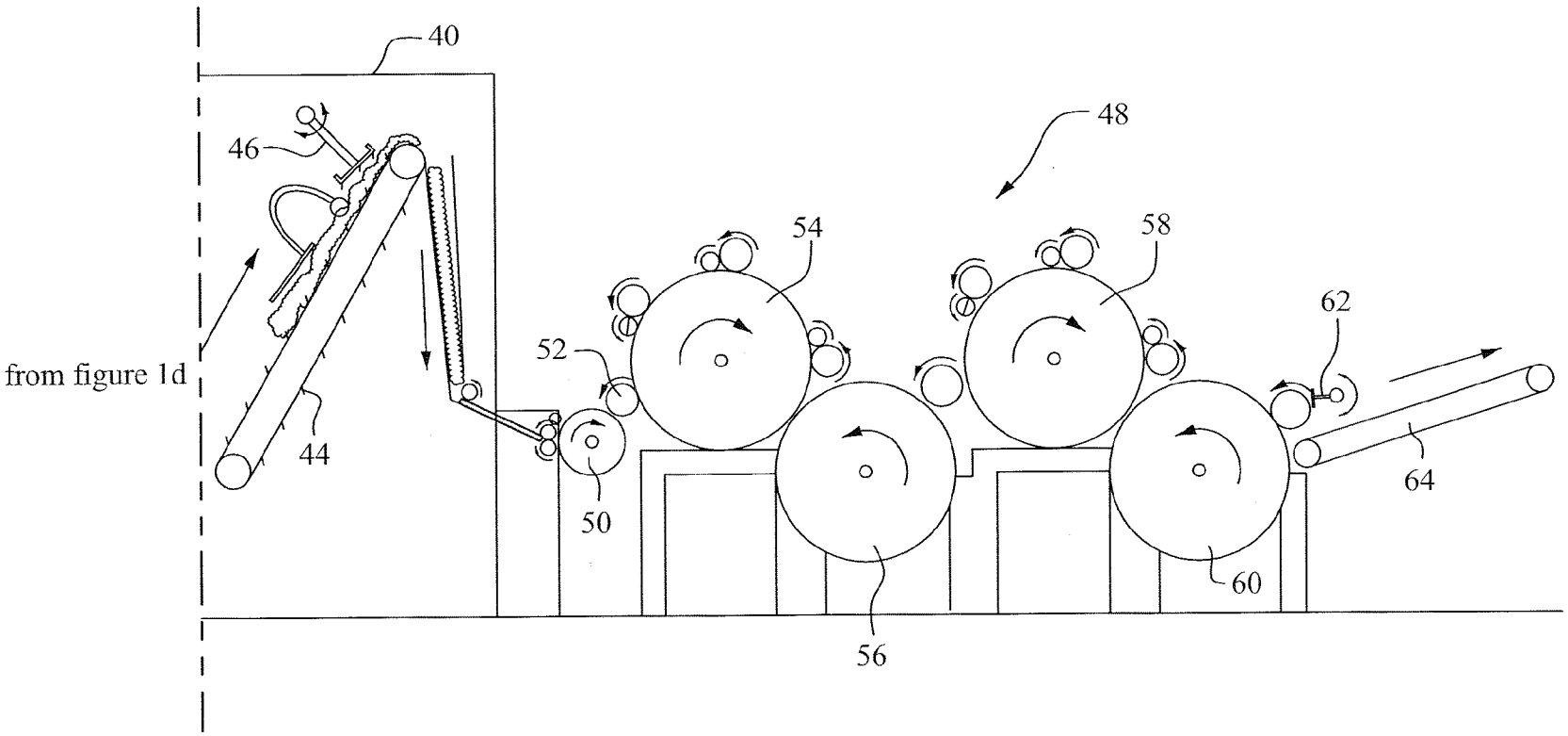
Figure 2 (Prior Art)
FIG. 2 is a schematic side elevational view of one example of a carding apparatus that can be used in accordance with the present invention.

As shown in FIG. 2, the carding apparatus 48 generally comprises a taker-in roller 50, a stripper 52, a breaker cylinder 54, an intermediate doffer 56, a main cylinder 58, a finisher doffer 60, a stripper and comb 62 and an exit conveyor 64. The carding apparatus 48 shown in FIG. 2 is merely an example of one type of carding apparatus that may be used in the present invention. Other types of carding apparatus may have different roller constructions and configurations.

Figure 3:
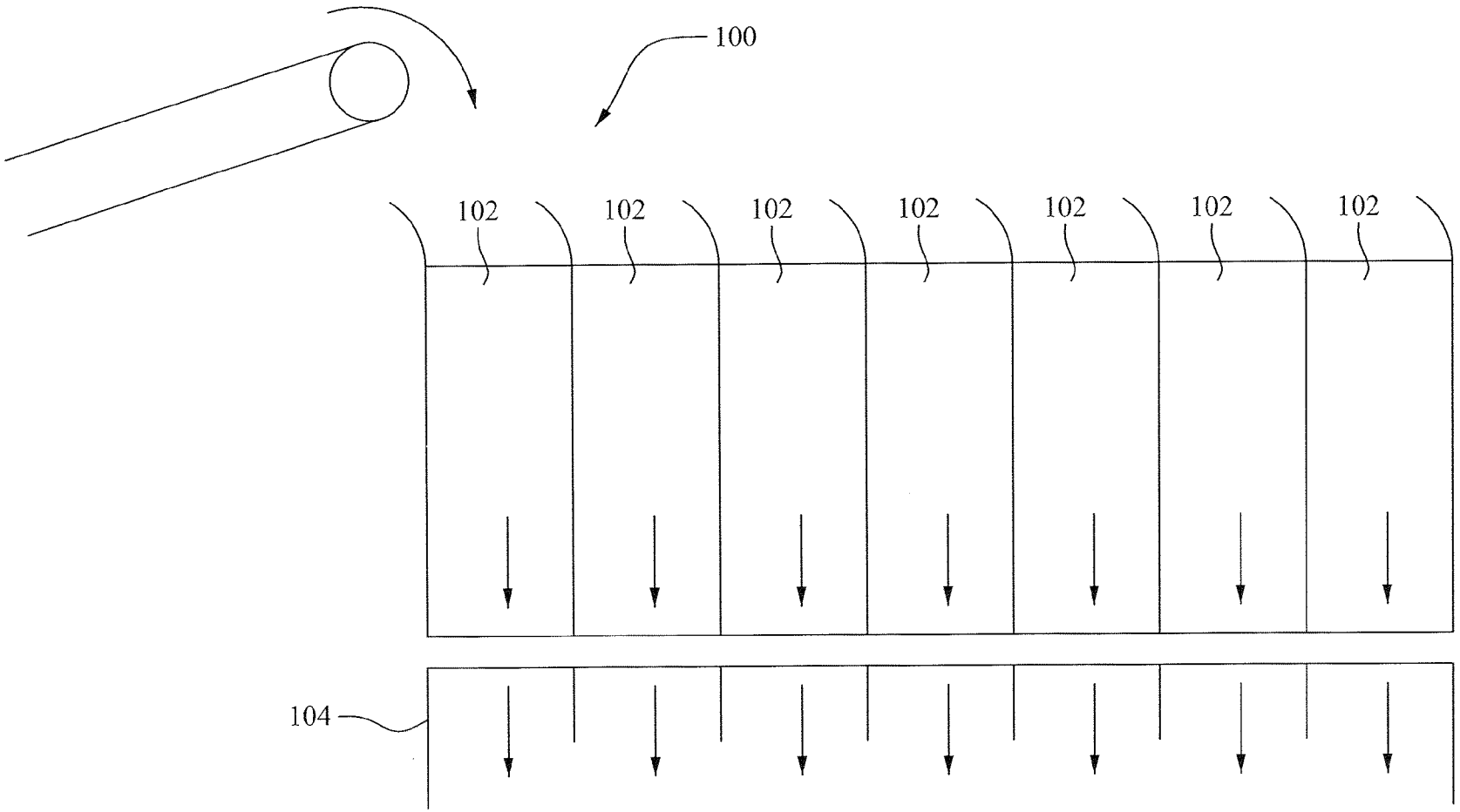
FIG. 3 is a schematic view of a shoot feed system for feeding fibers of different materials in laterally spaced relation in different shoots to a carding apparatus.

As shown in FIG. 3, in accordance with the present invention, the picker/feed system of FIGS. 1*a*-1*d* or another suitable feed system 100 comprises separate, laterally spaced chambers 102 having fibers formed of different materials contained therein. Within the scope of the present invention, any suitable or desired number of chambers 102 may, be provided in the feed system, each containing a different fiber material. The feed system 100 is constructed to feed the different fibers from the chambers 102 in laterally spaced relation as shown in FIG. 3 to the carding apparatus 104 of the present invention which may be the same as or different in general construction from the carding apparatus 48 shown in FIG. 2.

Figure 4:
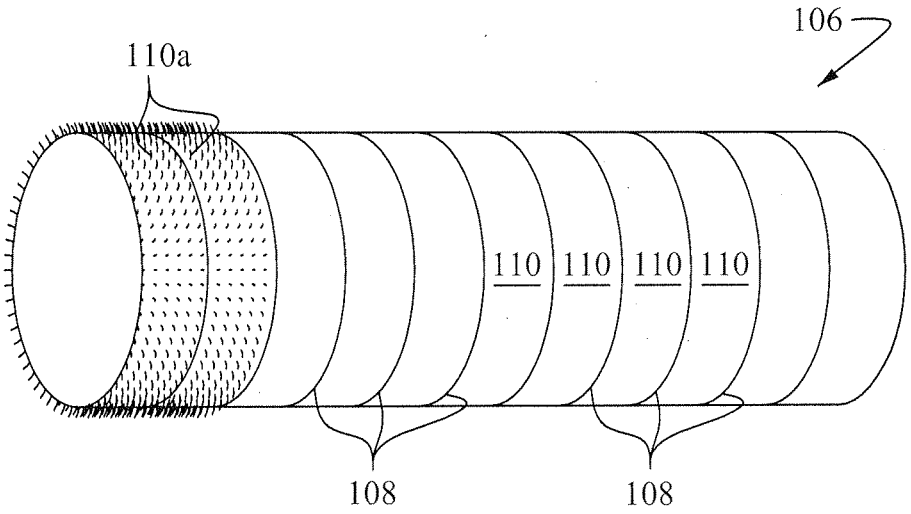
FIG. 4 is a side elevational view of a cylinder for a carding apparatus constructed in accordance with the present invention.
Figure 5:
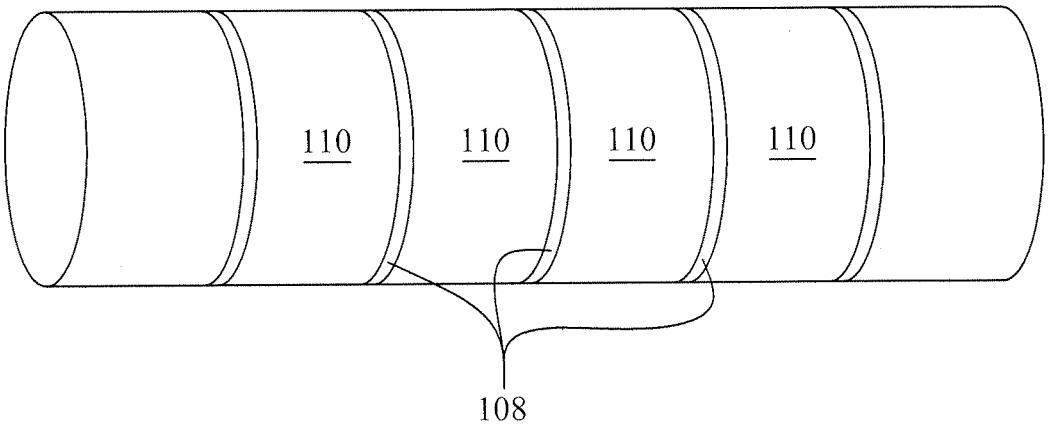
FIG. 5 is a side elevational view of a portion of the cylinder shown in FIG. 4.
Figure 5A:
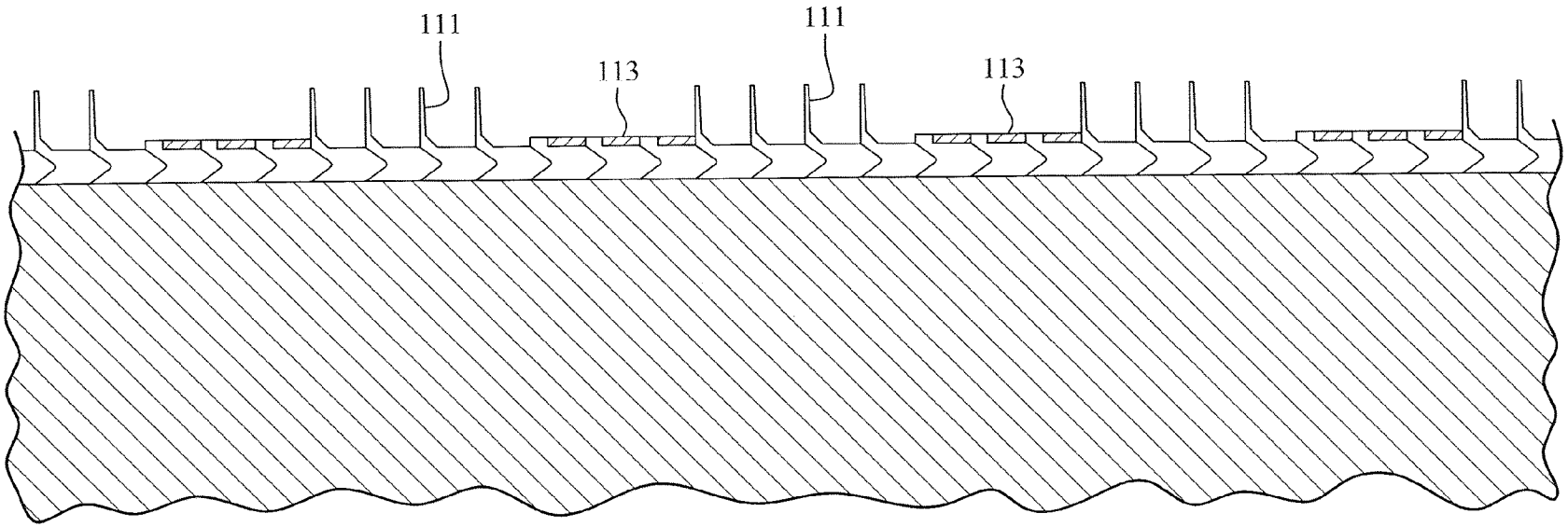
FIG. 5*a* is an enlarged side elevational view of standard card wire and interlocked modified card wire in accordance with the present invention.

As shown in FIG. 4, each main roller or cylinder 106, such as the workers, strippers and main cylinders, of the carding apparatus 104 is constructed with laterally spaced bands 108 that define laterally spaced sections 110 that correspond to and are aligned with the separate chambers 102 of the feed system 100. In this manner, the fibers from the separate feed chambers 102 are fed onto the separate sections 110 of the rolls or cylinders 106 of the carding apparatus 104 and the fibers of different materials are advanced through the carding apparatus in laterally spaced, substantially parallel relation. The separating bands 108 on the rollers 106 may be of any suitable construction. For example, the bands 108 may be formed of metal and welded onto the rollers 106 to separate the different, laterally spaced wired sections 110, or the bands 108 may be formed of flat wire that is interlocked with the carding wire in the separate sections 110, as shown in FIG. 5. For simplicity, only the sections 110*a* are shown with wire in FIG. 4. As illustrative examples, different types of carding wire 111 and 113 are shown in FIG. 5*a*.

For high speed and safe operation, it is important that each roll or cylinder 106 of the carding apparatus have bands of equal size, weight and spacing thereon to ensure that the roll is balanced for proper rotation.

With the new and improved carding apparatus of the present invention, each fiber of a different material is moved in longitudinal alignment through all of the rolls and cylinders of the carding apparatus and then the different fibers can be combined in a suitable manner to form a multi-fiber roving or web, as further explained hereinafter.

Figure 6:
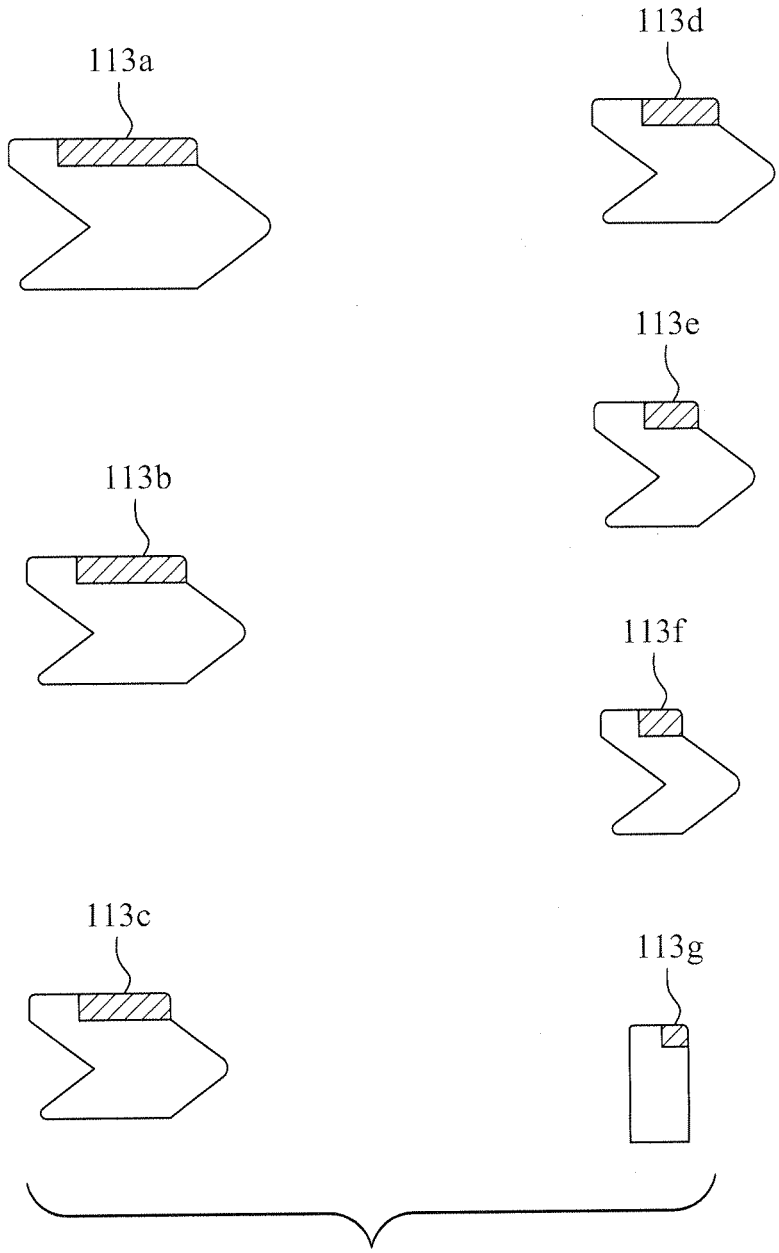
FIG. 6 shows different types of wires in cross section for the different cylinders of a carding apparatus in accordance with the present invention.

As illustrative examples, different embodiments of carding wires 113*a*-113*g* for the rolls and cylinders of the carding apparatus are shown in FIG. 6 and the specifications for the wires are set forth in FIG. 7.

Figure 8:
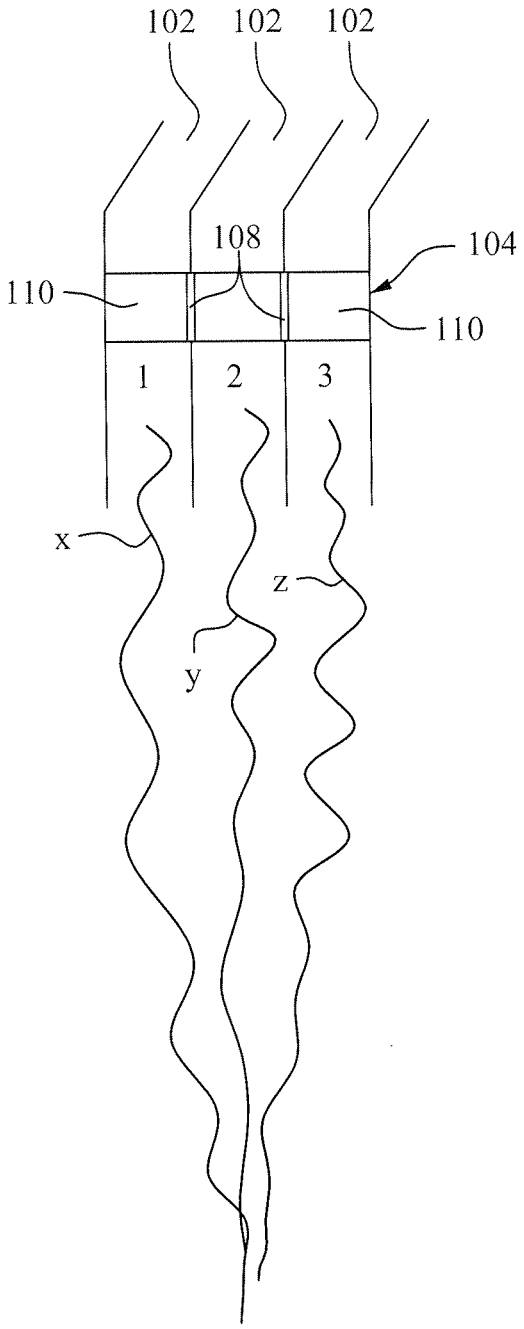
FIG. 8 is a schematic view showing the forming of rovings of fibers of different materials as they exit the carding apparatus of the present invention.
Figure 9:
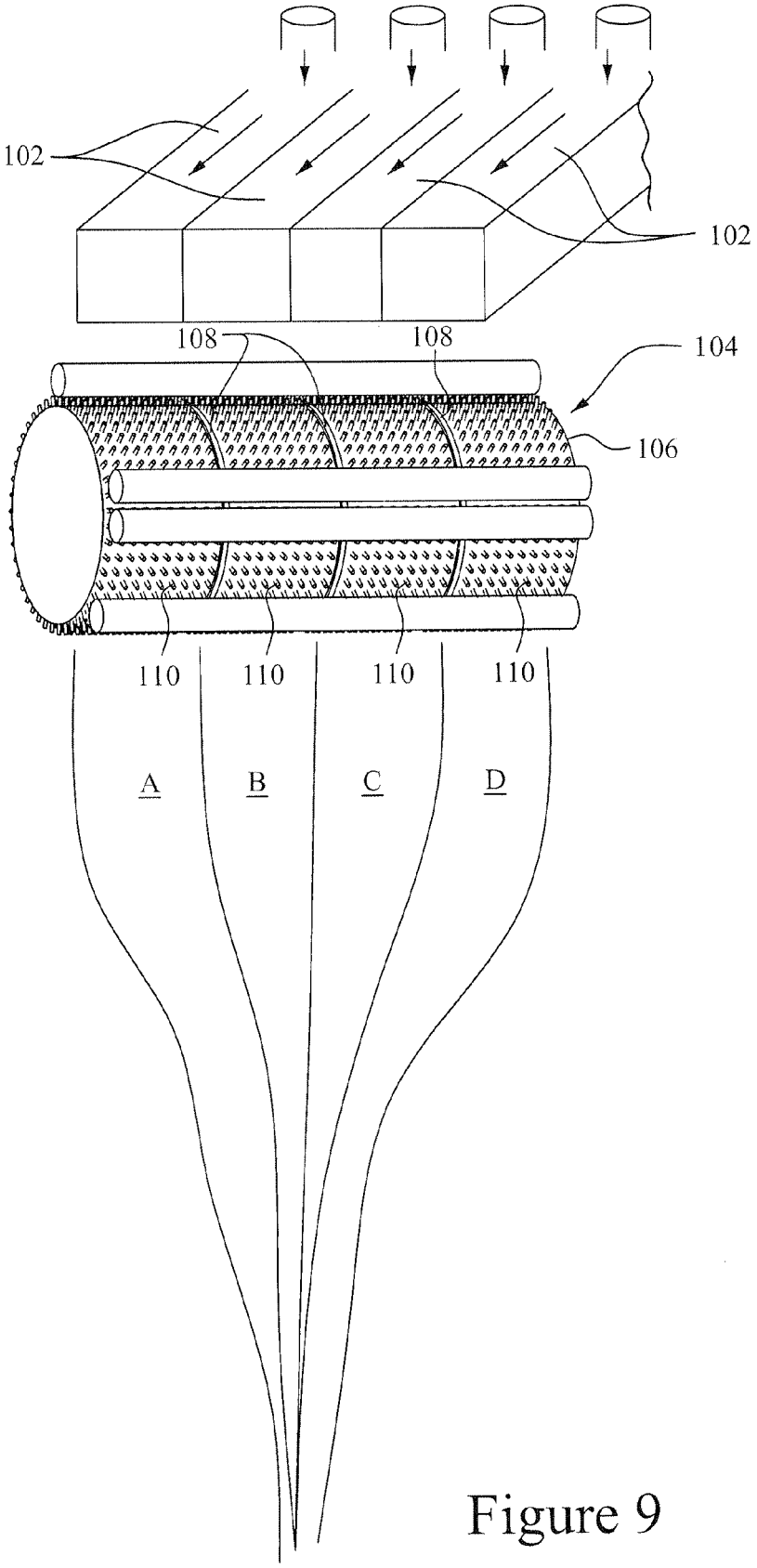
FIG. 9 is a schematic view showing the forming of a web of fibers of different materials after they exit the carding apparatus of the present invention.

FIG. 8 illustrates the combination and roving of three different fibers X, Y and Z after they exit the carding apparatus of the present invention through exit chutes 1, 2 and 3. Similarly, FIG. 9 illustrates the combination of four different fibers A, B, C, D in a formation of a web of these fibers after they exit the carding apparatus of the present invention. It will be readily seen that the new and improved carding apparatus of the present invention can produce multi-fiber rovings or webs of any suitable number, size and type in a single operation.

Figure 10:
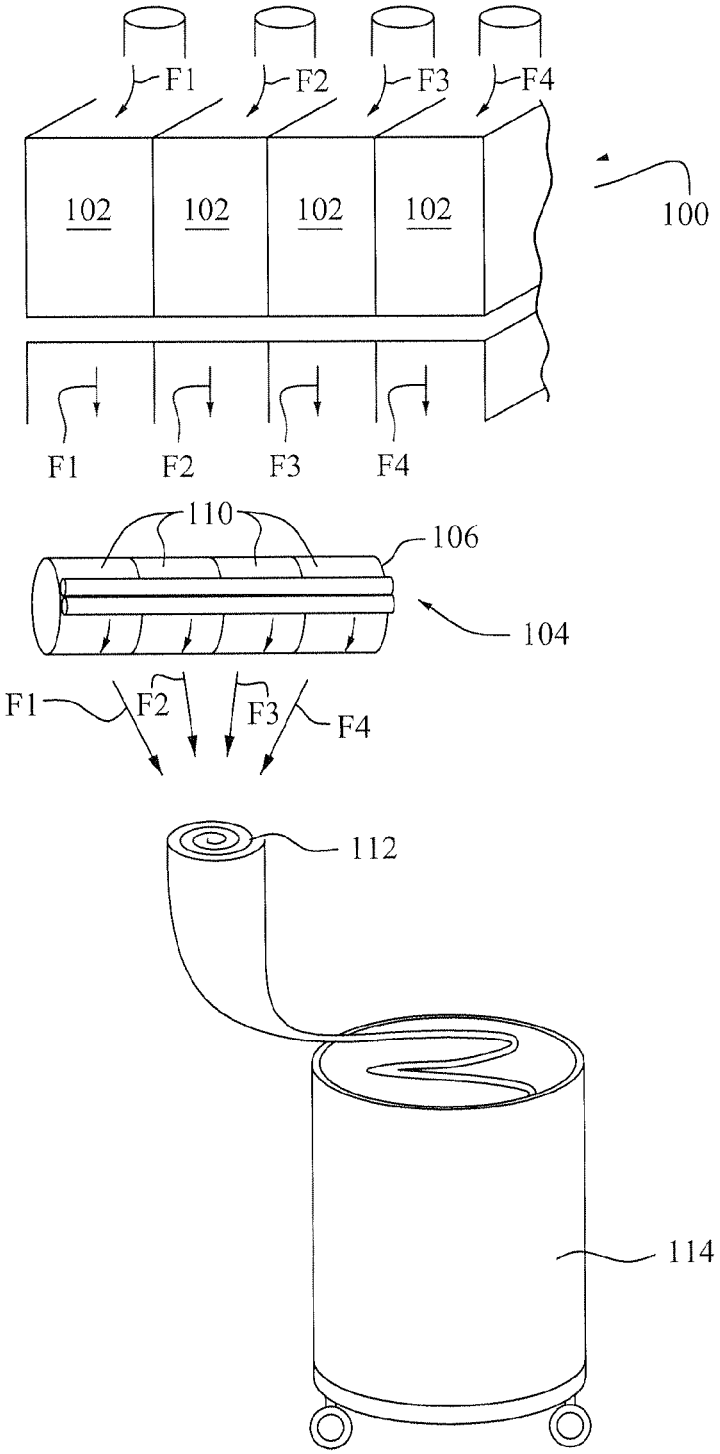
FIG. 10 is a schematic view of the feed, carding, doffing/roving and storage apparatus constructed in accordance with one embodiment of the method of the present invention.

As further shown in FIG. 10, the fibers F1-F4 of any suitable number or type of different materials are moved separately from the shoots 102 of the feed system 100 onto the laterally spaced sections 110 of the rolls and cylinders 106 of the carding apparatus 104. When the fibers of different materials exit the carding apparatus 104, they are combined into a roving or a web 112 (shown schematically) in any suitable or desired manner and then may be stored in a drum 114 or the like.

Figure 11:
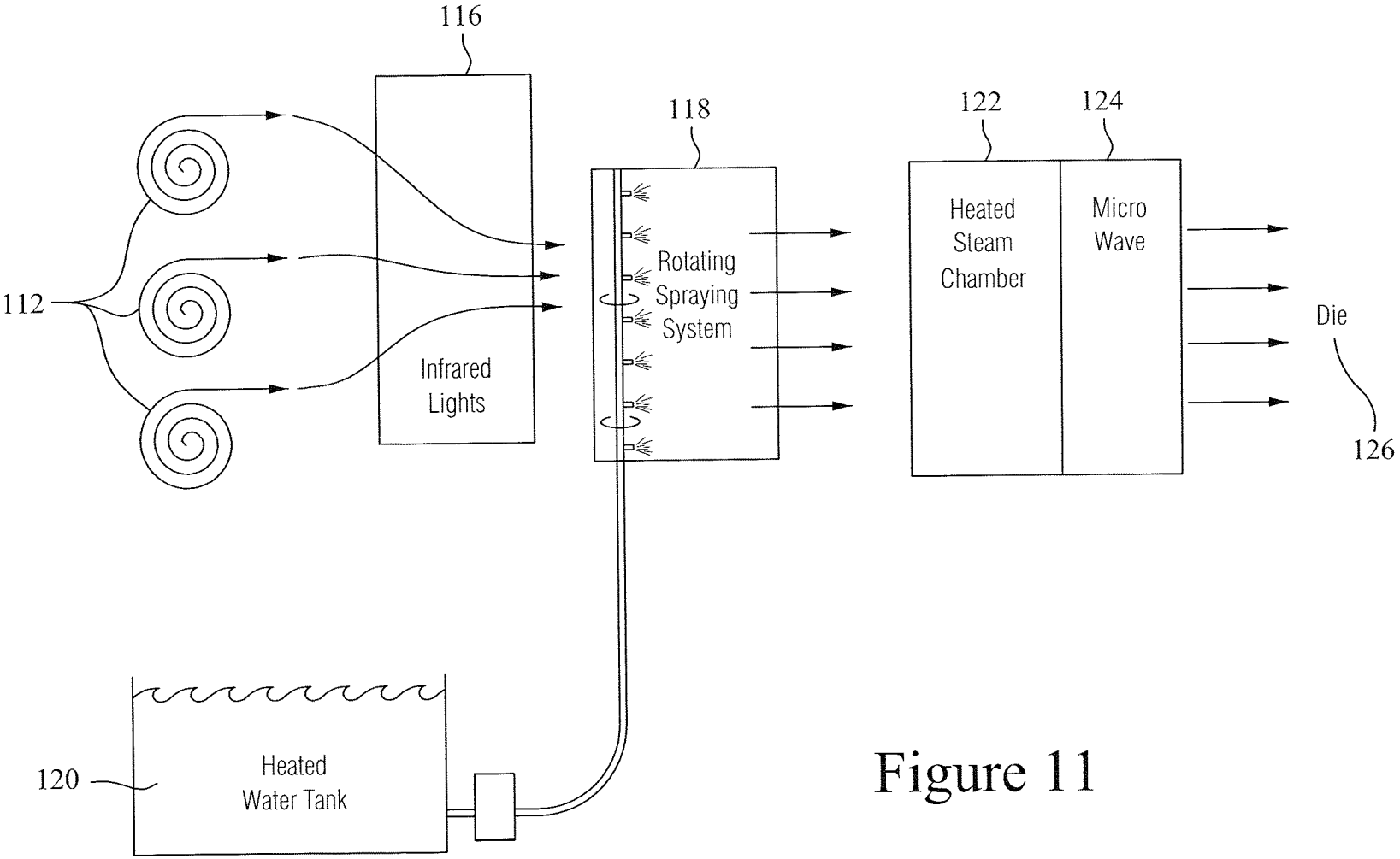
FIG. 11 is a schematic view of apparatus for further processing rovings or webs of fibers of different materials by subjecting them to moisture, heat and/or extrusion.

Depending on the different fibers in the roving or web 112, it may be necessary to further process them by heat or the like in order to properly combine them or fuse them together. As shown in FIG. 11, the multi-fiber rovings or webs 112 are then conveyed through a pre-heating infrared chamber 116, a heated water spray chamber 118 that is supplied by a heated water tank 120, a steam chamber 122, a microwave unit 124 and a cold or heated die 126.

As illustrative examples and depending on the different fibers to be combined or fused together, the infrared chamber 116 may be 70° F. to 170° F., the heated water spray chamber 118 may be 70° F. to 210° F., the steam chamber 122 may be 70° F. to 290° F., the microwave unit 124 may be 160° F. to 212° F., and the die 126 may be electrically heated from 70° F. to 400° F.

Figure 12:
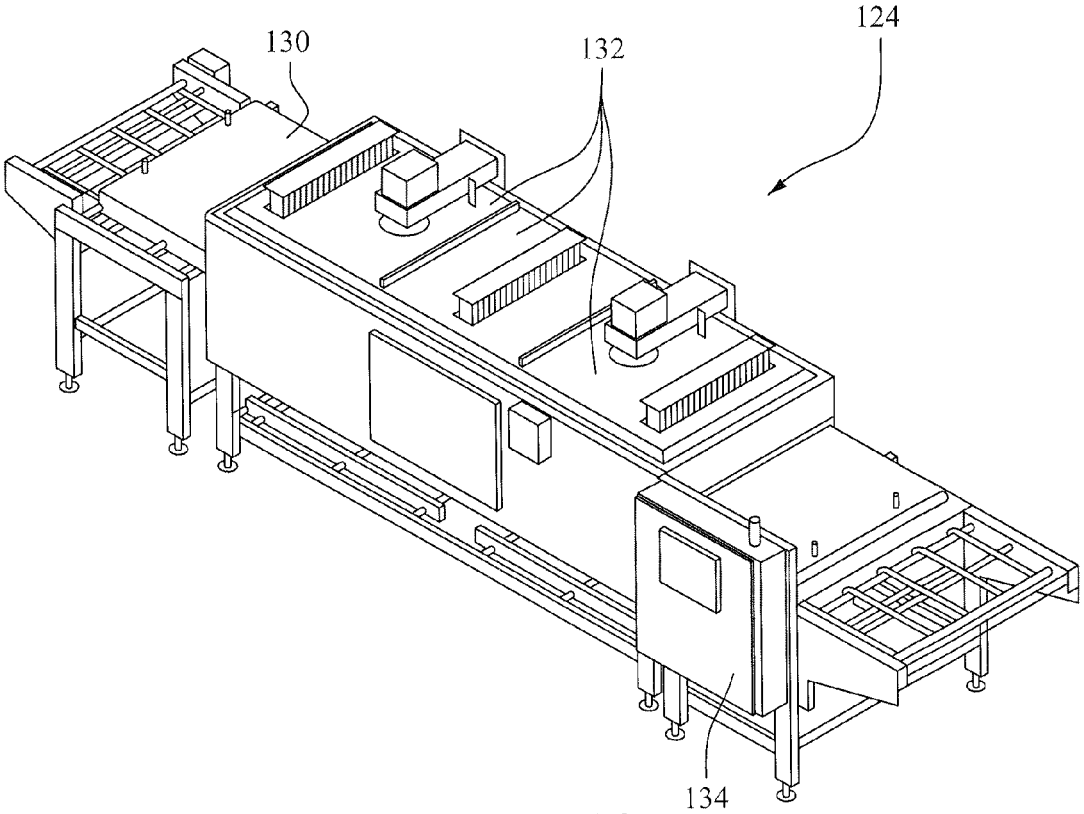
FIG. 12 shows multiple views of one example of a microwave unit in accordance with the present invention.

As shown in FIG. 12, the microwave unit 124 may comprise a conveyor 130 for moving the wet multi-fiber rovings or webs through one or more microwave devices 132 that are controlled by a control device 134. It is noted that, within the scope of the present invention, the microwave unit 124 may be of any other suitable or desired construction.

Figure 13:
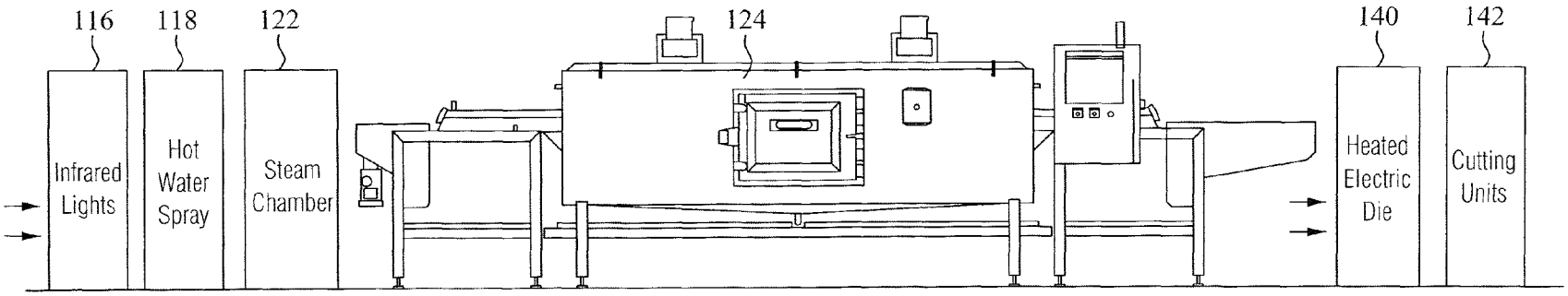
FIG. 13 is another schematic view of the apparatus for further processing rovings or webs of different materials by subjecting them to moisture, heat, extrusion and/or cutting.

FIG. 13 is a view similar to FIG. 11 and shows in more detail the infrared chamber 116, the heated water spray chamber 118, the steam chamber 122, the microwave unit 124, a heated die 140 and one or more cutting units 142.

From the foregoing description, it will be readily seen that the new and improved carding method and apparatus of the present invention can efficiently produce carded fibers of any suitable or desired different materials of any suitable type or number in a single efficient operation.

While the invention has been described in connection with what is presently considered to be the most practical and preferred embodiment, it is to be understood that the invention is not to be limited to the disclosed embodiment, but on the contrary, is intended to cover various modifications and equivalent arrangements included within the spirit and scope of the appended claims.

The invention claimed is:

1. A method of forming carded fibers of different materials, comprising:

providing a feed system having a plurality of separate laterally spaced chambers containing fibers of different materials;

feeding the different fibers in separate laterally spaced paths onto a plurality of rollers and cylinders in a carding apparatus, said rollers and cylinders each having laterally spaced sections in alignment with the laterally spaced paths to receive and maintain the different fibers in the laterally spaced paths therein as they move through the carding apparatus; the laterally spaced sections of the rollers and cylinders being separated by raised bands that are in laterally spaced relation thereon; and combining the different fibers into a multi-fiber roving or web after they exit the carding apparatus.

2. The method of claim 1 wherein the laterally spaced sections of the rollers and cylinders are of a width corresponding to a width of the different fiber paths.

3. The method of claim 1 wherein the bands are formed of metal and welded onto the rollers and cylinders.

4. The method of claim 1 wherein the laterally spaced sections contain spaced raised wires and the bands are interlocked with the spaced wires.

5. The method of claim 1 wherein the laterally spaced sections contain spaced raised wires and the raised bands are of less height than the raised wires.

6. The method of claim 1 wherein the bands are of the same size and weight, and are uniformly spaced on the rollers and cylinders so that they are balanced for proper rotation.

7. The method of claim 5 wherein the wires are in the form of narrow bars.

8. The method of claim 1 wherein the different fibers are combined by conveying them through a heated chamber.

9. The method of claim 8 wherein the different fibers are conveyed through a plurality of heated chambers comprising an infrared chamber, a humidifying chamber, a steam chamber and a microwave chamber.

10. The method of claim 9 wherein the humidifying chamber is a hot water spray chamber.

11. The method of claim 9 wherein the different fibers are further conveyed through a die.

12. The method of claim 11 wherein the die is heated.

13. The method of claim 11 wherein the fibers are further conveyed through a cutting unit.

* * * * *